US005816308A

United States Patent [19]

De Hoyos

[11] Patent Number: 5,816,308

[45] Date of Patent: Oct. 6, 1998

[54] SUPPORT DEVICE FOR MOUNTING OF HEADRAILS OF BLINDS AND THE LIKE

[75] Inventor: Edgar Eduardo De Hoyos, San Gabriel, Calif.

[73] Assignee: Kittrich Corporation, Los Angeles, Calif.

[21] Appl. No.: 840,312

[22] Filed: Apr. 11, 1997

[51] Int. Cl.[6] ..... A47H 1/14

[52] U.S. Cl. ..... 160/178.1 R; 160/902; 248/251

[58] Field of Search ..... 160/178.1 R, 173 R, 160/168.1 R, 902; 248/251, 262, 261, 254

[56] References Cited

U.S. PATENT DOCUMENTS

| | | | |
|---|---|---|---|
| 738,720 | 9/1903 | Gerth . | |
| 794,976 | 7/1905 | Glickman . | |
| 1,348,399 | 8/1920 | Fowler . | |
| 1,710,457 | 4/1929 | Lefebvre . | |
| 1,773,796 | 8/1930 | Settlemoire . | |
| 2,001,864 | 5/1935 | Benjinsohn . | |
| 2,454,449 | 11/1948 | Haws et al. . | |
| 3,175,796 | 3/1965 | Petrick . | |
| 4,224,974 | 9/1980 | Anderson et al. | 160/178.1 R |
| 4,235,406 | 11/1980 | Vecchiarelli . | |
| 4,475,706 | 10/1984 | Anderson | 160/902 X |
| 4,722,382 | 2/1988 | Vecchiarelli . | |
| 4,802,644 | 2/1989 | Oskam | 160/902 X |
| 4,938,443 | 7/1990 | Rowe | 160/178.1 R X |
| 4,949,926 | 8/1990 | Liu | 160/178.1 R X |
| 5,012,850 | 5/1991 | Schrader . | |
| 5,074,350 | 12/1991 | Carter . | |
| 5,121,893 | 6/1992 | King et al. . | |
| 5,180,130 | 1/1993 | McMichael | 160/902 X |
| 5,186,426 | 2/1993 | Wada | 160/902 X |
| 5,230,494 | 7/1993 | Adams . | |
| 5,353,857 | 10/1994 | Anderson | 160/178.1 R |
| 5,522,444 | 6/1996 | Liu . | |
| 5,533,560 | 7/1996 | Morris . | |

*Primary Examiner*—David M. Purol
*Attorney, Agent, or Firm*—Evan M. Kent, Esq.; Russ,August & Kabat

[57] ABSTRACT

The device effectively, efficiently, conveniently, and securely supports headrails of a type having a U-shaped cross section with first and second sidewalls joined by a connecting rear wall, the free ends of the sidewalls projecting inwardly to define first and second projections, respectively. The device comprises a selectively expandable and collapsible support having a top surface, a first side, a second side opposite the first side, a support surface on both the first and second sides, and may be fixed to a ceiling or wall. Structurally, the support comprises: a locking or latching mechanism for locking the support in an expanded condition in which the first and second projections at the free ends of the headrail sidewalls engage the support surfaces, and for releasing the expanded condition to place the support in a collapsed condition in which the spacing between the first and second support surfaces is insufficient to support both first and second projections at the free ends of the headrail sidewalls. If desired, the locking mechanism may provide three or more stable latched positions for accommodating different sized headrails.

14 Claims, 4 Drawing Sheets

FIG. 1
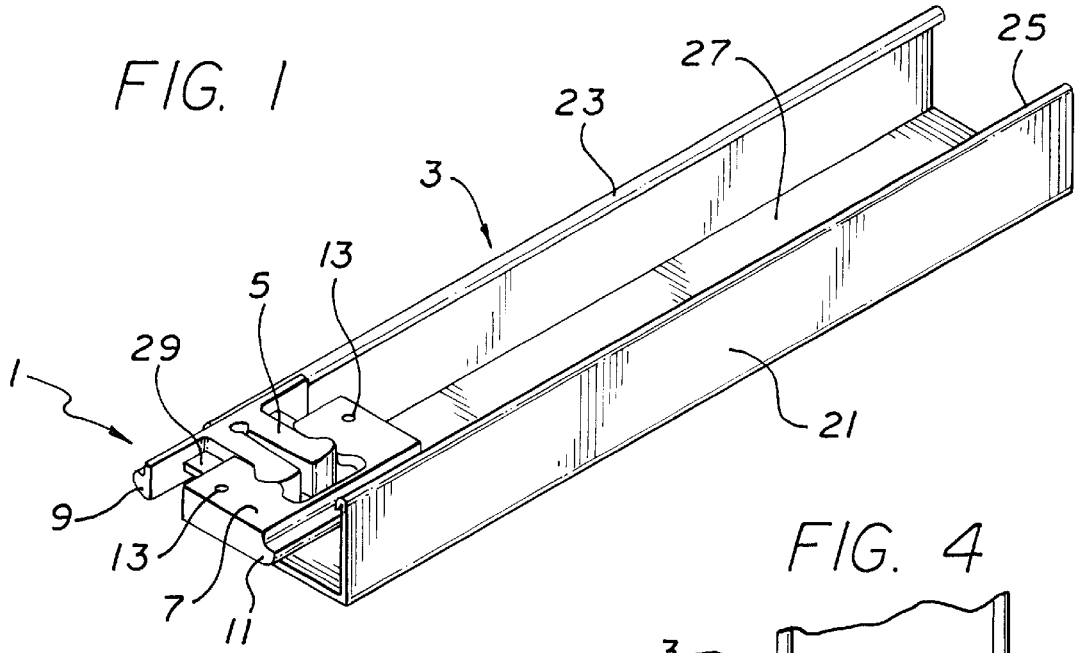
FIG. 4
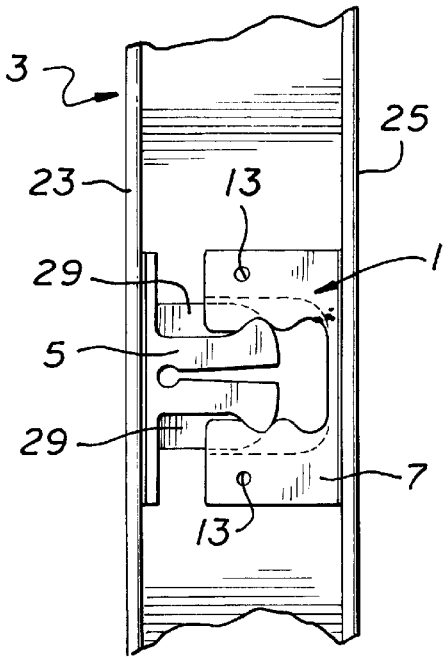
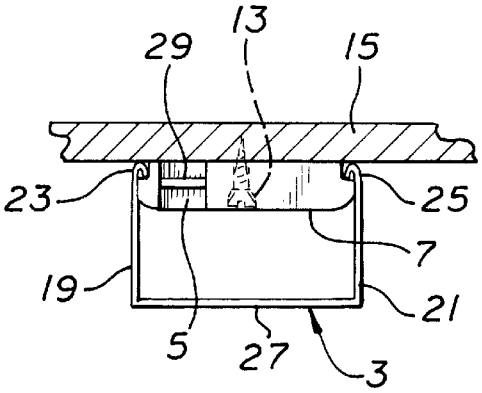
FIG. 3
FIG. 2
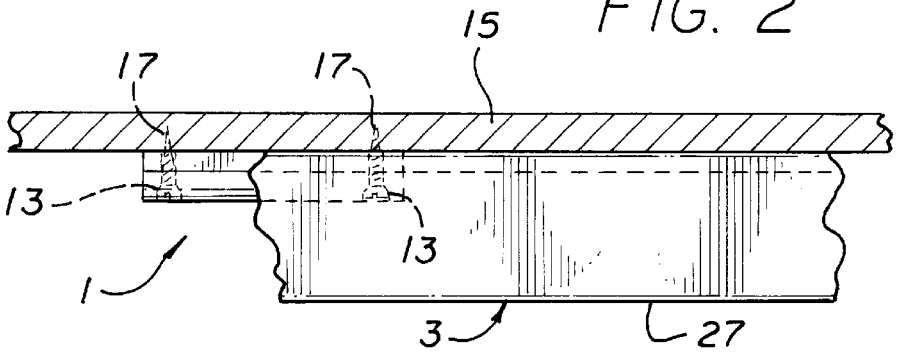

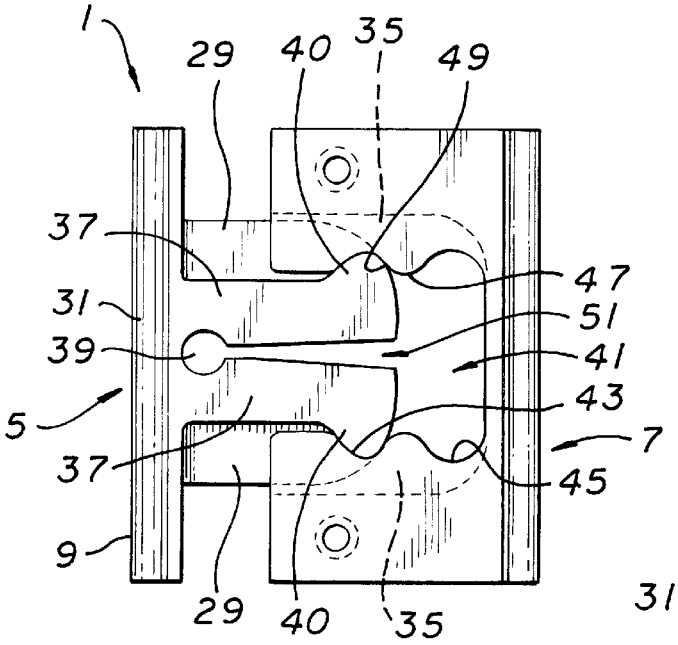
FIG. 8
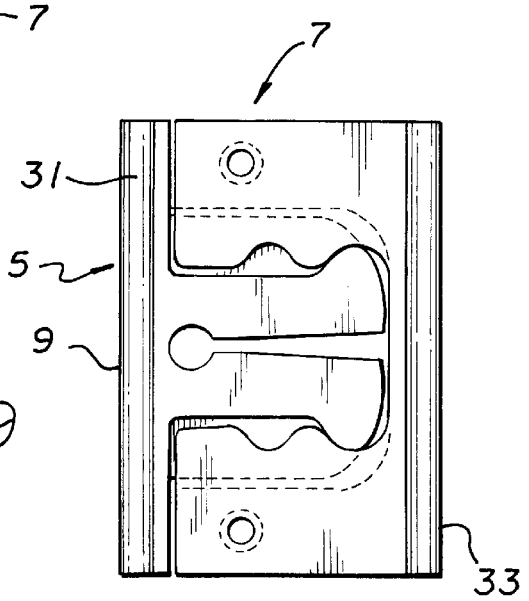
FIG. 9
FIG. 10
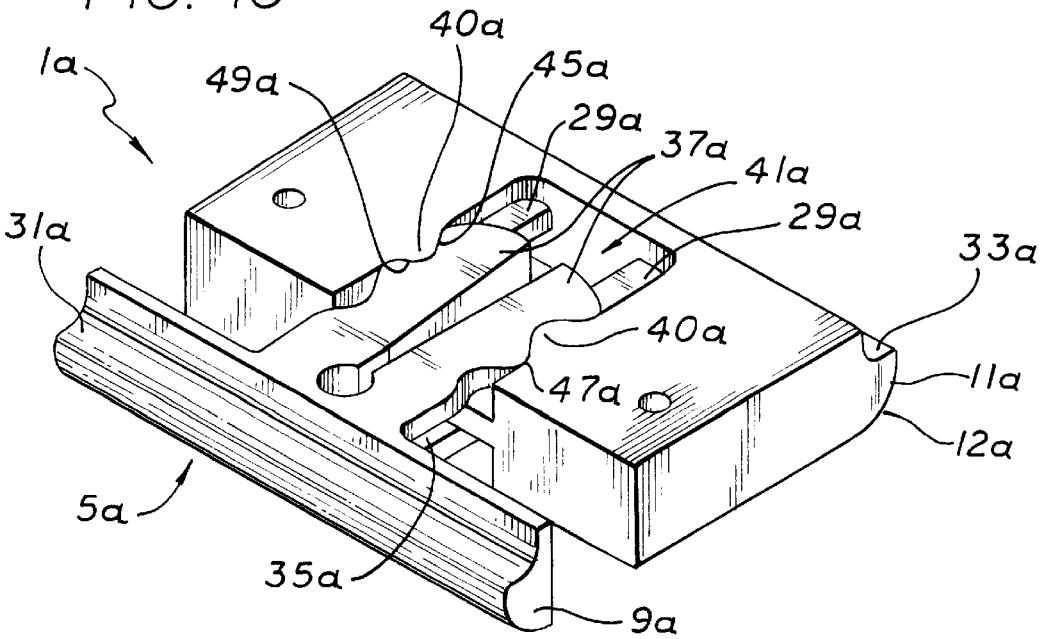

SUPPORT DEVICE FOR MOUNTING OF HEADRAILS OF BLINDS AND THE LIKE

BACKGROUND OF THE INVENTION

1. Field of the Invention

This invention is related to the field of supports for mounting of headrails, and more particularly to a support device for mounting headrails of blinds in windows or mounting headrails for any other need, whether such headrail is mounted on a horizontal wall (e.g., ceiling or window frame top) or on a vertical wall.

2. Brief Description of the Prior Art

Mounting brackets for installing headrails of Venetian blinds are well known. A variety of brackets for securing a headrail to the window frame top or to a ceiling have been proposed. Available types include hinged box end brackets, spring action devices, and brackets which mount to the window frame top or to a ceiling at locations other than the ends of the headrail. However, either these prior art brackets do not get completely covered by the headrail so as to require the mounting of a separate valance for cosmetic purposes, or the headrails they support must be mounted and removed by the use of tools having access to bracket mounting screws through unsightly holes provided in the headrail.

One prior art device referred to in U.S. Pat. No. 5,522,444 as a positioning device for a headrail of a Venetian blind which includes a pair of brackets each including a base plate mounted in a recess of the headrail near a distal end thereof, and at least one bore is defined through the base plate aligned with a corresponding hole formed in a bottom portion of the headrail. A positioning screw extends through the bore of the base plate and includes a head portion received in the space between the bore and the associated hole. Use of such a device requires tools to secure the headrail to the brackets and to release it therefrom, and further requires a valance or other covering to hide the access holes.

The mounting bracket according to U.S. Pat. No. 5,074,350 requires no tools to mount the headrail to the brackets, but the attachment mechanism is marginally effective to secure a blind headrail to the top wall or ceiling, requiring bent spring portions to retain a great deal of biasing force against the free ends of the headrail sidewalls. Releasing the headrail also requires special manipulation of the headrail to detach the headrail from the spring elements.

A common type of headrail end bracket for installing blinds, and in particular horizontal blinds, is what is referred to in the industry as a "box" bracket. Use of such a box type bracket makes the size of the headrail critical. If the headrail width is too small or too big, it will not fit the bracket. All box brackets are color coordinated. A 1" blind uses a 1×1 box bracket, 2" and 3" blinds use a 2×2 box bracket. All box brackets must be mounted at the extreme ends of the headrail and comprise two pieces, an aluminum box structure and a hingeable door that opens toward the interior of the room to allow the headrail to enter. Then the door is closed and latched to keep the headrail in place. After the headrail is put into place, a valance is used to cover the headrail and hide the box bracket. The valance is usually made out of the slat material of the blind, being the same color, and needs valance clips. The dimension of the valance is also critical. If the valance is not used, the box bracket is visibly exposed, and is usually aesthetically displeasing. An inventory of these box brackets is maintained by color and size. This is an additional cost to the manufacturing plant that is passed down to the user as is the cost of valance material and clips for the valance. Any of the above scenarios can be experienced in the use and installation of ½" miniblinds, 1", 2", and 3" horizontal blinds made of wood, aluminum, PVC, etc.

There are a number of other disadvantages in using the common box bracket. Box brackets are also usually visible from the outside of the window if one is looking at the window from the exterior, and, if the blind is installed in a high window, it is also visible from the interior looking up. Also, because of the door opening in opposite directions on either side of the blind, there is necessarily a left side and a right side bracket. The possibility of a bracket being installed upside down, on the wrong side, is very great, especially for the inexperienced installer. When using the regular box bracket on very wide blinds, the need exists for a center support giving rise to yet an additional cost, since the center supports are constructed differently than the left or right end support. And, if the center support is lost or not in the original shipment, no installation can be made. If a wholesaler or retailer is out of a certain color bracket, then that color blind cannot be installed completely, or at all. If the installation of the blind is on a window frame for which there are no instructions as to where the brackets should be placed (i.e., how far from the corners of the window frame), then the installation of the brackets requires special care and precision measuring; a fraction of an inch too short or too wide would jeopardize the correct installation. The box bracket, properly installed, requires a minimum of 4 screws per bracket and even more screws if a center support is required. Although widely used in high quantity, there is a cost factor involved in the assembly of the box bracket that is passed along to the ultimate purchaser, since the assembly of the door to the box via rivets is necessarily a labor intensive operation.

A company using the "standard box bracket" usually incurs the following costs: the inventory of ½", 1", and 2" size brackets, multiplied by every single color in each size; inventory for at least 8 screws for every pair of brackets and 4 screws for every center support; inventory for the valance clips which is usually 2 to 4 clips or more per blind, depending on the width of the blind; and the allocation for valance material to go with every blind.

SUMMARY OF THE INVENTION

The present invention solves the aforementioned problems associated with the use of prior art blind mounting hardware, making the support device according to the invention invisible after the headrail is attached, eliminating the excessive cost factors by forming a single device type using injection molding techniques and inexpensive plastic material, and greatly simplifying the assembly and disassembly procedure without the need for tools.

In accordance with the invention, there is provided a device for mounting of headrails of a type having a U-shaped cross section with first and second sidewalls joined by a connecting rear wall, the free ends of the sidewalls projecting inwardly to define first and second projections, respectively, the device comprising an expandable and collapsible support having a top surface, a first side, a second side opposite the first side, a support surface on both the first and second sides, and means for fixing the support to a ceiling or wall, and wherein the support comprises: means for locking the support in an expanded condition in which the first and second projections at the free ends of the headrail sidewalls engage the support surfaces;

and means for releasing the expanded condition to place the support in a collapsed condition in which the spacing between the first and second support surfaces is insufficient to support both first and second projections at the free ends of the headrail sidewalls.

In accordance with another aspect of the invention, there is provided a support device for mounting of headrails of a type having a U-shaped cross section with first and second sidewalls joined by a connecting rear wall, the free ends of the sidewalls projecting inwardly to define first and second projections, respectively, the support device comprising: a female member having a top surface, an inner side, an opening in the inner side, an outer side, a first support surface on the outer side, and means for fixing the female member to a ceiling or wall; and a male member having an outer portion, an inner portion, a second support surface on the male outer portion spaced from the first support surface, and a pair of spaced legs defining the male inner portion, the legs being received in the opening of the female member; and wherein sidewalls of the opening in the female member and outer sidewalls of the legs of the male member have irregular surfaces, whereby the legs interlock with the sidewalls of the opening at two stable positions, an expanded position at which the first and second projections at the free ends of the headrail sidewalls engage the first and second support surfaces, and a collapsed position at which the spacing between the first and second support surfaces is insufficient to support both first and second projections at the free ends of the headrail sidewalls.

The support device of the present invention utilizes the already existing upside down "J" shaped lip at the free ends of the sidewalls of the generally U-shaped headrail. This curved lip at the sidewall ends is a characteristic of all headrails formed by the extrusion process from raw aluminum. The rounded edge on top of the headrail is also beneficially used during mounting of the headrail to the support device(s).

A number of important features of the invention are: the provision of two inexpensive plastic pieces, a male member and a female member, that interjoin to slide relative to each other; the support device uses only two screws per unit or per support; the two holes in the support device for the screws are counter sunk and are in a preset area that is determined by where the most weight will be applied; the location of the bracket can be anywhere along the headrail and not necessarily at the ends; since the bracket is not visible, there is no need for color coordination; generally, there will be no need for a center support, since strategic placement of two support devices provides all the support that is needed; the dimensions of the support device have to change only for different size headrails, or a "one-size-fits-all" embodiment may be employed; the support device is unique in style, shape, and form; the same identical unit can be used either as a near end support or as a center support for long headrails; the need for a valance is eliminated; cost savings is also enjoyed by both the manufacturer and the end user due to the savings on screws, colored brackets, and center supports; and the installation of binds using the invention is simple and user friendly, since, after installing the support device, one only has to push the headrail up, and the blind headrail snaps into place. To release the headrail from the support device(s), one only has to either push forward or reverse on a side of the headrail, depending on application, or to simply squeeze the two sidewalls of the headrail toward one another where space permits.

When the support device of the present invention is holding the headrail, it is in the extended position; when the headrail is pushed or squeezed to release the attachment, the device slides into itself, therefore collapsing (effectively shrinking in size) and allowing the headrail to be easily removed. To reset the device, one need only to pull the support device back to its original position.

Precise installation of the support device only requires all mounted support devices to be "in line" with each other as to the left or to the right of each other, since one can slide the blind left or right for a symmetrical and perfect coverage of the window despite any inaccuracies in the spacing of the support devices on the ceiling or window frame top.

The support device is preferably made out of plastic, which is less expensive to manufacture than the two piece box type bracket described above. Suitable plastic materials include nylon, ABS, PVC, polypropylene, and polycarbonate, to name a few.

BRIEF DESCRIPTION OF THE DRAWING

The invention will now be described in detail having reference to the accompanying drawing in which:

FIG. 1 is a perspective view of a support device made in accordance with the invention, partially inserted into the end of a headrail, the position of the support device extending over the edge of the headrail being shown for illustration purposes only, to show the relative attachment position and cooperation between the headrail and the device;

FIG. 2 is a side elevation view of a support device mounted to the ceiling or top frame of a window, with the headrail partially drawn and the ceiling or top frame of a window shown in cross section;

FIG. 3 is a left end view of the arrangement shown in FIG. 2;

FIG. 4 is a plan view of the top side of a support device with a headrail installed are attached to it, as it would be seen from the perspective of the ceiling;

FIG. 8 is a plan view of the male and female members as in FIG. 7, as viewed from the top;

FIG. 9 is a plan view of the male and female members as in FIG. 7, as viewed from the top, but with the male and female members in the collapsed position;

FIG. 10 is a perspective view similar to that of FIG. 7 showing an alternate configuration of the undulations on the sides of the male member leg portion and the female member opening;

DETAILED DESCRIPTION OF THE PREFERRED EMBODIMENTS

Figure 5:
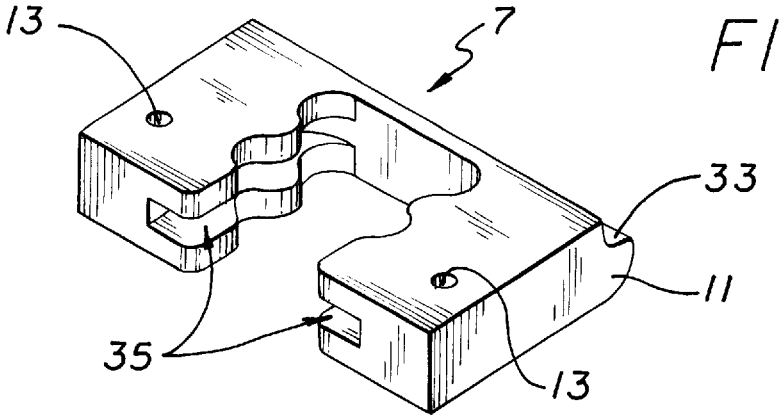
FIG. 5 is a perspective view of the female member component of the support device according to the invention.

FIG. 1 is a perspective view of a concealed headrail support 1 positioned relative to a headrail 3. In a typical installation, the headrail support 1 will be positioned between the ends of the headrail 3, but the relative position of these two units are shown in FIG. 1 for purposes of illustration, especially to show the engagement between the headrail support 1 and headrail 3 in a fully installed condition.

Headrail support 1 is comprised of interlocking male and female members 5, 7 which may be selectively interlocked at two relative positions of the male and female members, defining an expanded condition as shown in FIG. 1 and a collapsed condition as is shown in FIG. 9 to be described later.

In the expanded condition shown in FIG. 1, the male member 5 has an outer rail support portion 9, while the female member 7 has an oppositely directed rail support portion 11, the spacing between the male and female rail support portions 9, 11 being determined by the standard spacing between the free ends of the sidewalls 19, 21 of headrail 3.

FIG. 1 is the position of the headrail support 1 and headrail 3 as these units would be mounted against the ceiling of a building structure or against the upper window frame top. A pair of mounting holes 13 are predrilled into the female member 7 through which two screws are inserted from below and screwed into the ceiling or window frame top such that the top surface of the male and female members 5, 7 are flush with the ceiling or window frame top. Only the female member 7 is screwed in place.

The headrail 3, of common construction, has a pair of sidewalls 19, 21 joined by a common connecting rear wall 27. The free ends of the sidewalls 19 and 21 curve inwardly and then downwardly to form a shape commonly referred to as an upside down "J" shape. Such headrails 3 are typically manufactured by extruding aluminum, such that the configuration shown in FIG. 1 for headrail 3 is easily produced and has become standard in the industry. It is to be understood, however, that the concealed headrail support I according to the present invention is fully and equally operable with any headrail design made of any material in which a pair of flexible sidewalls 19, 21 are provided having inwardly directed projections similar to curved ends 23, 25 shown in the embodiment of FIG. 1 as J-hook portions.

FIG. 2 is a partial cross sectional view showing the concealed headrail support 1 screwed to a ceiling or window frame top structure 15 by two screws 17 inserted through mounting holes 13 and screwed into the ceiling/wall structure 15. In this connection, it should also be noted that, although the preferred embodiments of the invention are shown in a position to be mounted against a ceiling or window frame top, the invention works equally well when the headrail support 1 is mounted on a vertical wall, and the headrail 3 is maintained in a vertical position against the wall, as used in conjunction with an "L" bracket, held there by the headrail support 1, yet releasable therefrom as will be described hereinafter. Thus, while the invention finds great value and use in the Venetian blind industry in particular, the concealed support 1 may be employed for holding any of a number of U-shaped rails having movable sidewalls, even if such rails are solely for decorative purposes.

FIG. 3 shows a left end view of the arrangement of FIG. 2. In this figure, the engagement, or contact, relationship between the male and female members 5, 7 and the sidewalls 19, 21 of the headrail 3 can be better appreciated.

FIG. 4 is a plan view of an installed headrail support 1 supporting a headrail 3 from the prospective of the ceiling or window frame top. Obviously, with the support 1 fully contained within the U-shaped channel of the headrail 3, the headrail support 1 is fully concealed and consequently is functional while offering the benefits described in the Summary of the Invention.

Figure 6:
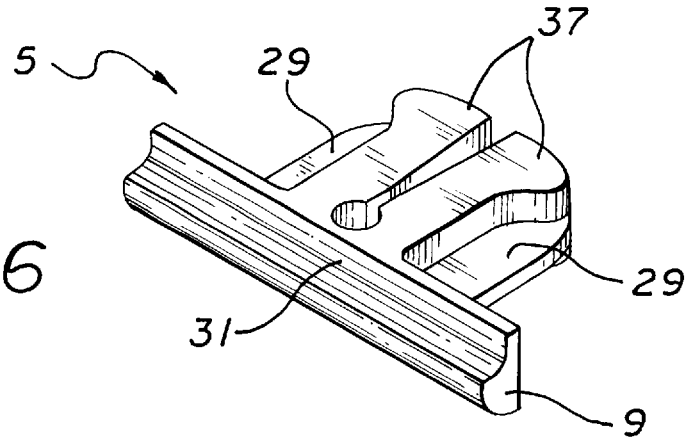
FIG. 6 is a perspective view of the male member component of the support device according to the invention.
Figure 7:
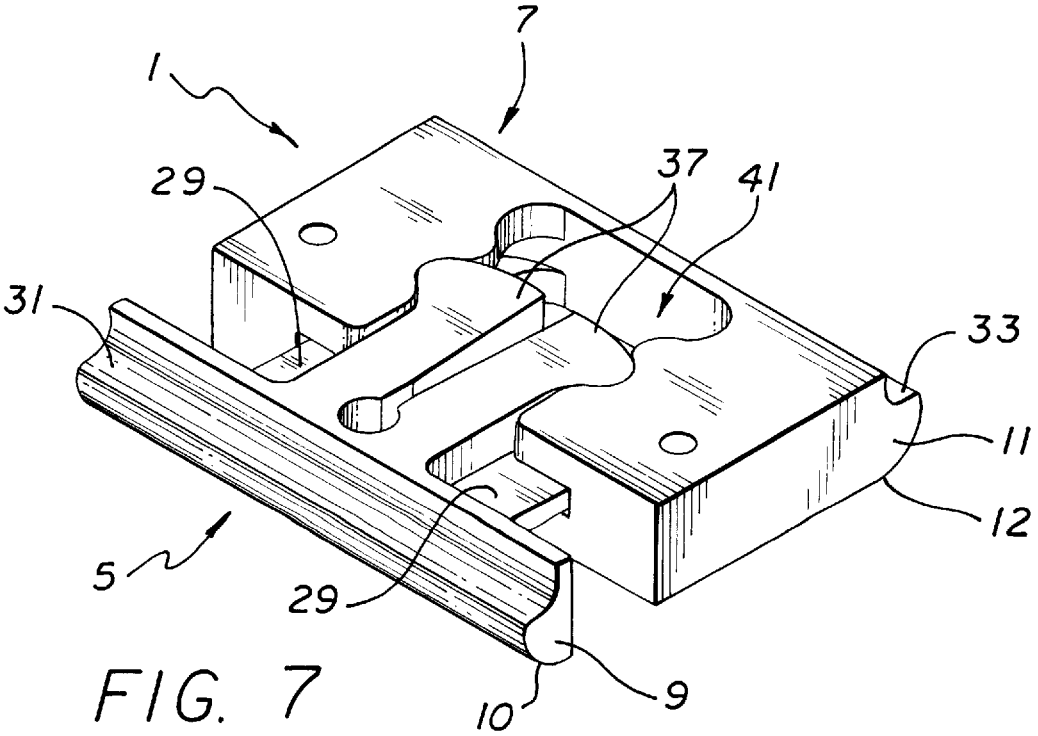
FIG. 7 is a an enlarged perspective view of the male and female members in the initial expanded or extended position.

The male and female members 5, 7 are designed and configured to move relative to one another with the male member moving further into or further out of the female member to lock or latch at collapsed and expanded positions of the members, respectively. This is best understood by reference to FIGS. 8 and 9, with FIG. 8 showing the expanded condition of support device 1 and FIG. 9 showing the collapsed condition. For clarity of understanding the operational relationship between the male and female members 5, 7, FIGS. 5 and 6 are provided to show, respectively, a perspective view of the female member 7 and a perspective view of the male member 5. FIG. 7 is a perspective view of the two members 5, 7 in the expanded condition.

FIGS. 5–7 also serve to illustrate best the cooperation between the ribs 29 centrally disposed on the outside surface of a pair of legs 37 of male member 5 and the slots or grooves 35 formed in the walls of the opening 41 in the female member 7. Due to the configuration of the legs 37 of the male member 5 and the opening 41 in the female member 7, without the ribs 29, the male member 5 would simply drop down into the channel of the headrail 3. Ribs 29, therefore stabilize the male member 5 vertically (in FIG. 7) relative to the screw-mounted female member 7. The length of the ribs 29 is such that they extend to the end of the pair of split legs 37, while the grooves 35 extend the full length of the sidewalls of the opening 41 in female member 7. Such a design maintains the stability of the male member 5 relative to the female member 7 in a direction normal to the axis of the ribs 29 or grooves 35 regardless of the position of the legs 37 within the opening 41 in the female member 7.

The concealed headrail support 1 is shown in the expanded condition in FIGS. 1, 4, 7, and 8. The two legs 37 of male member 5 are spaced apart by a small angle V-shaped slit 51 (FIG. 8) forming a gap between the two legs 37 leading to a circular strain relief area 39. With this construction, and with the male member 5 being made of a plastic material, legs 37 are solid, but flexible enough to be moved toward one another filling the gap or slit 51. The preformed configuration of the legs 37 of male member 5 is (shown apart from the female element of the invention) in FIG. 6. In the initial assembly of the male and female members 5, 7, the ends of legs 37 are pushed into opening 41 with the ribs 29 aligned to fit into grooves 35. The distal ends of legs are slightly rounded, and each leg 37 has a curved outwardly directed foot or bump 40 near its extremity. Thus, upon initial insertion of the male member 5 into the female member 7, the curved surfaces at the ends of legs 37 are effective to cam the legs 37 toward one another until the bumps 40 snap or lock into place with the bumps 40 fitting into conformed outer lateral reliefs 43 in the undulated sidewalls of the opening 41 in the female member 7. This initially inserted position of the male member relative to the female member defines the expanded position of the male and female members 5, 7 or the expanded condition of the concealed headrail support 1.

As best seen in FIGS. 5–7, the male rail support portion 9 has a lower rounded surface 10 extending longitudinally of the outer edge of male member 5, and, similarly, female rail support portion 11 has a longitudinal curved surface 12 extending along its outer side as well. These rounded lower edge portions 10 and 12 of rail support portions 9 and 11, respectively, are important during the installation process, as it is these surfaces against which the rounded tops of the J-hook portions 23, 25 of the headrail 3 bear when the headrail is brought into contact with the headrail supports 1. As the installer pushes upwardly on the headrail 3, the rounded tops of the J-hook portions 23, 25 are cammed outwardly by curved surfaces 10, 12, forcing the J-hook portions 23, 25 to easily be moved upwardly until the J-hook portions 23, 25 snap into position with the downwardly directed extremity of the J-hook portions 23, 25 lie against the longitudinal surfaces 31, 33 of the male and female members 5, 7, respectively. Again, this is the expanded condition of the headrail support 1 and is the condition of the headrail support 1 shown in FIGS. 1, 4, 7, and 8. Because the female member 7 is screwed to the ceiling or window frame top, and because the bumps 40 on the legs of the male member are locked into the expanded position relative to the female member 7, the headrail 3 is held solidly in place with excellent holding security, i.e., the lateral distance between longitudinal surfaces 31, 33 is equal to the distance between J-hook portions 23, 25 in the relaxed condition of headrail 3. Once the sidewalls 19, 21 of headrail 3 move back together after passing surfaces 10, 12 it would be virtually impossible to pull the headrail 3 off the ceiling or window frame top without pulling the screws holding the headrail support 1 in place out with it.

In the event that it becomes necessary to remove the headrail 3 from the headrail support 1, this is easily done without tools by simply pushing at least one of the sidewalls 19, 21 of the headrail 3 toward the other sidewall, or, preferably, squeezing the two sidewalls together. By doing so, the inner surfaces of sidewalls 19, 21 of the headrail 3 push against the outer sides of the male and female rail support portions 9, 11, and this forces the legs 37 of the male member 5 to move closer together as the bumps 40 are cammed inwardly by the camming edges, or stops, 49. As the bumps 40 pass over the camming edges 49, the legs 37, again, come together until they pass the pair of intermediate stops 47, at which position the legs 37 expand outwardly due to the plastic memory of the material of which the male member 5 is made, and the bumps 40 snugly fit into the concave inner lateral reliefs 45. In this relative position of the male and female members, the distance between the male and female rail support portions 9, 11 is much less than the distance between the corresponding J-hook portions 23, 25 of the headrail 3. This position of the male member, or the condition it defines, is referred to as the collapsed condition, and since the distance between the male and female rail support portions 9, 11 is less than the distance between the J-hook portions 23, 25, the headrail 3 is completely released and is easily removed from the headrail supports 1 without obstruction.

Importantly, in a preferred embodiment of the invention, after the male member 5 and female member 7 move closer together, they are locked into the collapsed condition as described. In this manner, there is no opportunity for the male member 5 to inadvertently be moved backwards out of the collapsed condition to temporarily interfere with the removal of the headrail 3.

In the preferred embodiments shown in FIGS. 1–9, the female member 7 has been shown to have undulations formed in the sidewalls of the opening 41, and the male member has been shown to have laterally extending bumps or rounded feet 40 conforming to the shape of the concave lateral reliefs 43, 45 of the female member 7. In an alternative embodiment of the invention, the undulations may be formed in the outer surface of the legs of the male member 5, and a single rounded bump or projection may be provided on the sidewalls of the opening 41 in the female member 7. This configuration is shown as support device 1*a* in FIG. 10 with like elements being labeled with corresponding reference numbers with the letter "a" indicating the alternative configuration.

As a further alternate embodiment of a feature of the invention, in the arrangement of FIGS. 1–9 the ribs are provided on the outer portion of the male member 5, and a groove is provided in the sidewalls of the female member 7. This configuration may be reversed so that the ribs are on the female member 7 and the grooves are formed in the male member 5. Again, this altered configuration is shown in FIG. 10 with reference numerals corresponding to those in previously described figures having the same function.

Any type of device that is expandable and collapsible and can maintain the expandable and collapsible states can be used in place of the sliding male/female members 5, 7 shown as exemplary. Telescoping tubes with detented expanded and collapsed positions are a reasonable substitute, as is a detented plunger and cylinder arrangement, to name only two.

In order to accommodate different sizes of headrails with a single support device, a modification of the basic two-position sliding male/female arrangements shown in FIGS. 1–10, may be provided. Such modified support device is shown in FIGS. 11–16 and is characterized by a multiple-position sliding male/female arrangement. For example, rather than the undulations on the cooperating surfaces of the male and female members having only two stable mutually engageable conditions (or relative male and female positions), three or more stable conditions are provided.

Figure 15:
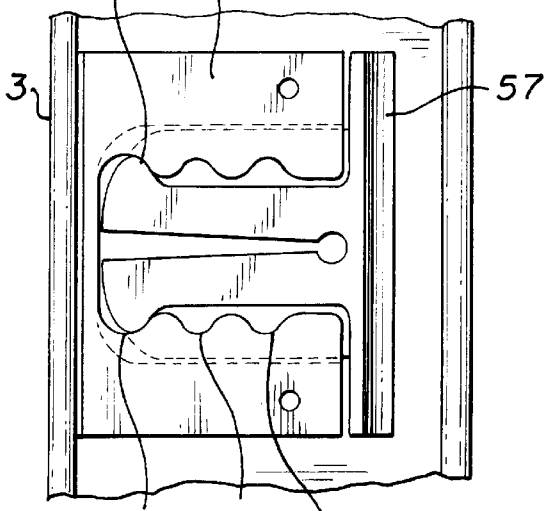
FIG. 15 is a plan view of the multiple-position sliding male/female arrangement shown in FIG. 11 with the male/female members in a collapsed condition.
Figure 16:
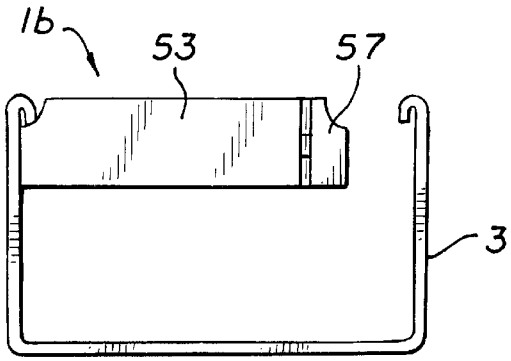
FIG. 16 is an end view of the assembly shown in FIG. 15.
Figure 13:
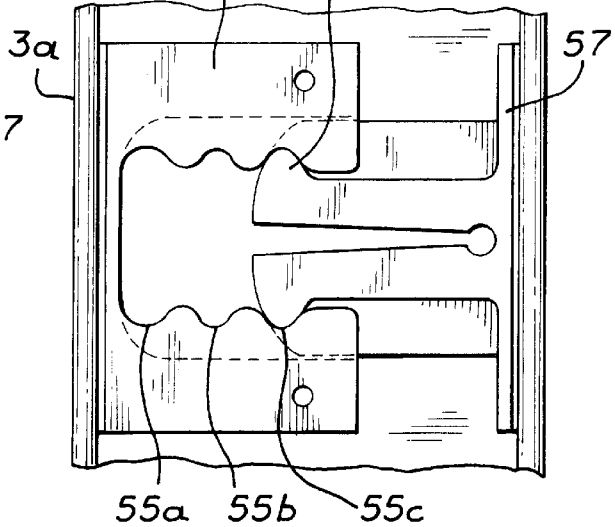
FIG. 13 is a plan view of the multiple-position sliding male/female arrangement shown in FIG. 11 mounting a 2" headrail.
Figure 14:
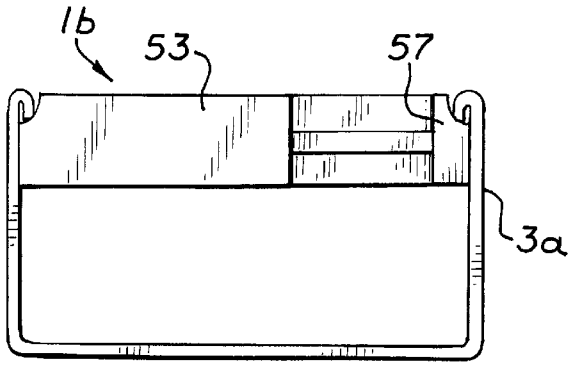
FIG. 14 is an end view of the assembly shown in FIG. 13.
Figure 11:
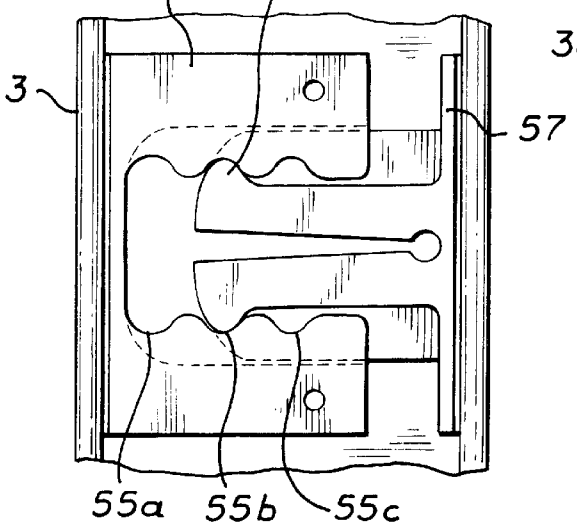
FIG. 11 is a plan view of an alternate form of the invention characterized by a multiple-position sliding male/female arrangement mounting a 1 ½" headrail.
Figure 12:
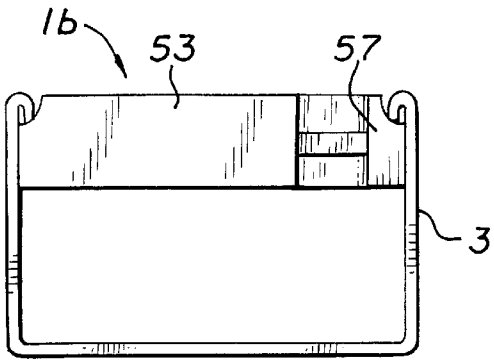
FIG. 12 is an end view of the assembly shown in FIG. 11.

Implementation of this modification is straightforward once the interlocking relationship between the two movable members according to this invention is understood. Accordingly, the plan views of support device 1*b* in FIGS. 11–13 and the end views in FIGS. 14–16 show one possible configuration for a multiple-position support device 1*b*. The walls of the opening in the female portion 53 have three (and may have more) lateral reliefs 55*a*, 55*b*, and 55*c*, rather than two. In this manner, the outwardly directed bumps (or feet) of the legs of the male member 57 can engage in any one of the plurality of reliefs 55*a*, 55*b*, 55*c*. Similarly, the undulations of the cooperating walls in FIG. 10 can be modified to provide a similar number of stable multiple-positions. FIGS. 11 and 12 show the support device 1*b* in the center position representing the expanded condition for a 1 ½" wide headrail. FIGS. 13 and 14 show the support device 1*b* in the most extended position representing the expanded position for a 2" wide headrail. FIGS. 15 and 16 show the support device 1*b* in the most compact position representing the collapsed condition for use with the 1 ½" wide rail of FIGS. 11 and 12. In the latter condition, the support device 1*b* is of a width insufficient to span across the width of headrail 3, thereby releasing the headrail 3 from the support device 1*b*. As will be observed, the center position of the male and female parts 57, 53 in FIGS. 11 and 12 represent the collapsed condition for the device for the 2" wide headrail of FIGS. 13 and 14.

Another practical example is a three-position arrangement (e.g., three lateral reliefs in the female member 53 sidewalls), wherein a first (most expanded) stable position of the male and female members 57,53 defines the expanded condition for use with a 3" headrail, while a second (central) stable position defines the collapsed condition for releasing the 3" headrail 3 from the support device. For use as a universal support device, if the central lateral relief (e.g., 55*b* in FIG. 11) is spaced 1" inwardly from the outer lateral relief, the central position defines the expanded condition for a 2" headrail. In such a case, a third (most collapsed) stable position then defines the collapsed condition for releasing the 2" headrail 3 from the support device. Any number of intermediate stable positions can be provided as needed or desired.

While the invention has been shown in several forms and described in alternative embodiments, it is obvious to those skilled in the art that the invention is not so limited, but is susceptible of various changes and modifications without departing from the spirit and scope of the claimed invention. Accordingly, the invention is to be limited only by the appended claims which are intended to cover other mechanical equivalents of the embodiments illustrated herein.

What is claimed is:

1. A device for mounting of headrails of a type having a U-shaped cross section with first and second sidewalls joined by a connecting rear wall, the free ends of the sidewalls projecting inwardly to define first and second inwardly directed projections, respectively, said device comprising an expandable and collapsible support having a top surface, a first side, a second side opposite said first side, a support surface on both said first and second sides, and means for fixing said support to a ceiling or wall, and wherein said support comprises:

means for locking said support in an expanded condition in which the first and second projections at the free ends of the headrail sidewalls engage said support surfaces; and means for releasing said expanded condition to place said support in a stable collapsed condition in which the spacing between said first and second support surfaces is less than the distance between said first and second projections, insufficient to support both first and second projections at the free ends of the headrail sidewalls.

2. The device as claimed in claim 1, wherein said support comprises interlocking male and female members slidable relative to one another and selectively interlocking at expanded and collapsed positions defining said expanded and collapsed conditions, respectively.

3. The support device as claimed in claim 2, wherein said male and female members are slidable from said expanded position to said collapsed position by moving at least one of the headrail sidewalls toward the other.

4. The support device as claimed in claim 2, wherein:

one of said male and female members comprises at least one rib, and the other comprises at least one groove receiving said at least one rib, whereby said male and female members are enabled to slidably move between said expanded and collapsed positions while being prevented from moving relative to one another normal to an axis of said rib or groove.

5. The support device as claimed in claim 2, wherein said male and female members are slidable from said expanded position to an intermediate position, or from an intermediate position to another intermediate position, or from an intermediate position to said collapsed position by moving at least one of the headrail sidewalls toward the other.

6. A support device for mounting of headrails of a type having a U-shaped cross section with first and second sidewalls joined by a connecting rear wall, the free ends of the sidewalls projecting inwardly to define first and second projections, respectively, said support device comprising:

a female member having a top surface, an inner side, an opening in said inner side, an outer side, a first support surface on said outer side, and means for fixing said female member to a ceiling or wall; and a male member having an outer portion, an inner portion, a second support surface on said male outer portion spaced from said first support surface, and a pair of spaced legs defining said male inner portion, said legs being received in said opening of said female member; and wherein sidewalls of said opening in said female member and outer sidewalls of said legs of said male member have irregular surfaces, whereby said legs interlock with said sidewalls of said opening at two stable positions, an expanded position at which the first and second projections at the free ends of the headrail sidewalls engage said first and second support surfaces, and a collapsed position at which the spacing between said first and second support surfaces is insufficient to support both first and second projections at the free ends of the headrail sidewalls.

7. The support device as claimed in claim 6, wherein said legs of said male member are slidable in said opening of said female member between said expanded and collapsed positions.

8. The support device as claimed in claim 7, wherein:

the first and second projections bear against said first support surface and said second support surface, respectively, in said expanded position; and said legs of said male member are slidable from said expanded position to said collapsed position by squeezing the headrail sidewalls toward each other, said male legs being movable toward one another into the space between them to release the interlock at said first position.

9. The support device as claimed in claim 6, wherein: one of said male and female members comprises at least one rib, and the other comprises at least one groove receiving said at least one rib, whereby said male and female members are enabled to slidably move between said expanded and collapsed positions while being prevented from moving relative to one another normal to an axis of said rib or groove.

10. The support device as claimed in claim 6, wherein:

at least one of said legs has an outwardly directed bump; and at least one of said sidewalls of said opening has two lateral reliefs spaced along said at least one sidewall in the direction of insertion of said legs into said opening, said at least one bump being received in one of said lateral reliefs to define said expanded position and being received in the other of said lateral reliefs to define said collapsed position, said one lateral relief being nearer the entrance of said opening than said other lateral relief.

11. A device for mounting of headrails of a type having a U-shaped cross section with first and second sidewalls joined by a connecting rear wall, the free ends of the sidewalls projecting inwardly to define first and second projections, respectively, said device comprising an expandable and collapsible support having a top surface, a first side, a second side opposite said first side, a support surface on both said first and second sides, and means for fixing said support to a ceiling or wall, and wherein said support comprises:

means for locking said support in an expanded condition;

means for locking said support in a collapsed condition; and means for locking said support in at least one intermediate condition; wherein:

in said expanded condition, the first and second projections at the free ends of the headrail sidewalls of a relatively large size headrail engage said support surfaces, and in an intermediate condition the spacing between said first and second support surfaces is insufficient to support both first and second projections at the free ends of the headrail sidewalls; and in an intermediate condition, the first and second projections at the free ends of the headrail sidewalls of a relatively small size headrail engage said support surfaces, and in said collapsed condition the spacing between said first and second support surfaces is insufficient to support both first and second projections at the free ends of the headrail sidewalls.

12. The device as claimed in claim 11, wherein said support comprises interlocking male and female members slidable relative to one another and selectively interlocking at expanded, intermediate, and collapsed positions defining expanded, intermediate, and collapsed conditions, respectively.

13. The support device as claimed in claim 12, wherein:

one of said male and female members comprises at least one rib, and the other comprises at least one groove receiving said at least one rib, whereby said male and female members are enabled to slidably move between said expanded, intermediate, and collapsed positions while being prevented from moving relative to one another normal to an axis of said rib or groove.

14. The support device as claimed in claim 12, wherein:

said male member has a pair of spaced legs;

said female member has an opening therein with sidewalls to receive said pair of spaced legs;

at least one of said legs has an outwardly directed bump; and at least one of said sidewalls of said opening has at least three lateral reliefs spaced along said at least one sidewall in the direction of insertion of said legs into said opening, said at least one bump being received in one of said lateral reliefs to define said expanded position and being received in other of said lateral reliefs to define said intermediate and said collapsed positions, said one lateral relief being nearer the entrance of said opening than said other lateral reliefs.

* * * * *